US007668497B2

(12) United States Patent
Maeda et al.

(10) Patent No.: US 7,668,497 B2
(45) Date of Patent: Feb. 23, 2010

(54) IMAGE HEATING ROLLER, IMAGE HEATING HEATER, WITH MICROWAVE BLOCKING LAYER

(75) Inventors: Yoritsugu Maeda, Toride (JP); Hiromichi Tsujino, Moriya (JP); Eijiro Atarashi, Toride (JP); Koji Doi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 11/679,437

(22) Filed: Feb. 27, 2007

(65) Prior Publication Data

US 2007/0201915 A1 Aug. 30, 2007

(30) Foreign Application Priority Data

Feb. 28, 2006 (JP) ..... 2006-052804

(51) Int. Cl.
*G03G 15/20* (2006.01)

(52) U.S. Cl. ..... 399/330

(58) Field of Classification Search ..... 399/330, 399/336

See application file for complete search history.

(56) References Cited

U.S. PATENT DOCUMENTS

| | | | | |
|---|---|---|---|---|
| 4,435,072 | A | 3/1984 | Adachi et al. | 355/3 |
| 4,482,239 | A * | 11/1984 | Hosono et al. | 399/336 |
| 4,542,980 | A * | 9/1985 | Tajima | 399/336 |
| 2005/0002703 | A1* | 1/2005 | Morgenweck et al. | 399/336 |
| 2006/0067754 | A1* | 3/2006 | Gilmore et al. | 399/333 |

FOREIGN PATENT DOCUMENTS

| | | |
|---|---|---|
| JP | 57-97560 | 6/1982 |
| JP | 61-6386 | 1/1986 |
| JP | 3-293691 | 12/1991 |
| JP | 2003-280421 | 10/2003 |

* cited by examiner

*Primary Examiner*—Quana M Grainger
(74) *Attorney, Agent, or Firm*—Fitzpatrick, Cella, Harper & Scinto

(57) ABSTRACT

An image heating roller for heating a toner image on a recording material. The image heating roller includes a heat generation layer for generating heat by a microwave introduced into a hollow portion of the image heating roller. The image heating roller further includes a blocking layer, provided on the heat generation layer, for substantially blocking passing of the microwave.

5 Claims, 10 Drawing Sheets

IMAGE HEATING ROLLER, IMAGE HEATING HEATER, WITH MICROWAVE BLOCKING LAYER

FIELD OF THE INVENTION AND RELATED ART

The present invention relates to an image heating roller, an image heating heater, and an image heating apparatus, which are employed by an image forming apparatus, such as a copying machine, a printer, a facsimile machine, etc., to heat an image on a recording medium. As examples of an image heating apparatus, there are a fixing apparatus for fixing an unfixed image on recording medium, and a glossiness increasing apparatus for increasing a fixed image on a recording medium in glossiness by heating the fixed image.

An image forming apparatus such as a copying machine, a printer, etc., has an image forming portion, and an image heating fixing apparatus (which hereafter will be referred to as a fixing apparatus) for thermally fixing a toner image formed on a recording medium in the image forming portion, to the recording medium.

As one of the fixing methods employed by a fixing apparatus, the thermal fixing method has been known. A fixing apparatus which employs the thermal fixing method is provided with a fixation roller and a pressure roller, which are kept pressed against each other, providing thereby a compression nip (fixation nip). It fixes an unfixed toner image on a recording medium, to the recording medium by applying heat and pressure to the unfixed toner image and recording medium while conveying the recording medium and the unfixed image thereon through the compression nip (fixation nip) between the fixation roller and pressure roller, by rotating the fixation roller and pressure roller.

As the heat source for a fixing apparatus employing an image fixing method, such as the one described above, which uses a heat roller, a halogen heater is used, the radiant heat from which is used to heat the fixation roller. This structural arrangement for a fixing apparatus has been widely known.

However, a structural arrangement, such as the one described above, which is based on the prior art, is low in the efficiency with which heat is transmitted from a halogen heater to a fixation roller. Therefore, it takes a substantial length of time to heat a fixation roller, and also, it takes a substantial amount of electrical power to heat the fixation roller.

As examples of other methods for thermally fixing an unfixed toner image, there have been proposed various methods which directly irradiate a toner image with the microwaves from a microwave generating apparatus to melt toner in order to fix the unfixed toner image (see, for example, Japanese Laid-open Patent Application 2003-280421), in particular, the method which directly irradiates toner with microwaves by guiding microwaves with a comb-shaped microwave guiding tube (see, for example, Japanese Patent Application Publication 61-6386).

Further, there has also been proposed a microwave based image fixing method, which heats rollers, which pinch and convey recording paper, by irradiating the rollers with the microwaves from an external source (see, for example, Japanese Laid-open Patent Application 3-293691, and Japanese Laid-open Patent Application 57-97560).

However, in the cases of the microwave based fixing methods disclosed in Japanese Laid-open Patent Application 2003-280421, Japanese Patent Application Publication 61-6386, Japanese Laid-open Patent Application 3-293691, and Japanese Laid-open Patent Application 57-97560, the microwaves with which objects, such as the toner, roller, etc., are to be irradiated, is present in the same space as the space through which the recording paper (recording medium) is conveyed. Thus, the space, in which the toner, rollers, etc., are irradiated with microwaves, has an inlet (hole) through which recording paper is conveyed into the space, and an outlet (hole) through which recording paper is conveyed out of the space. Therefore, it is difficult to satisfactorily prevent the microwaves from leaking out of the apparatus.

SUMMARY OF THE INVENTION

The primary object of the present invention is to provide an image heating roller, an image heating heater, and an image heating apparatus, which leaks virtually no microwaves.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Image Forming Portion

Figure 1:
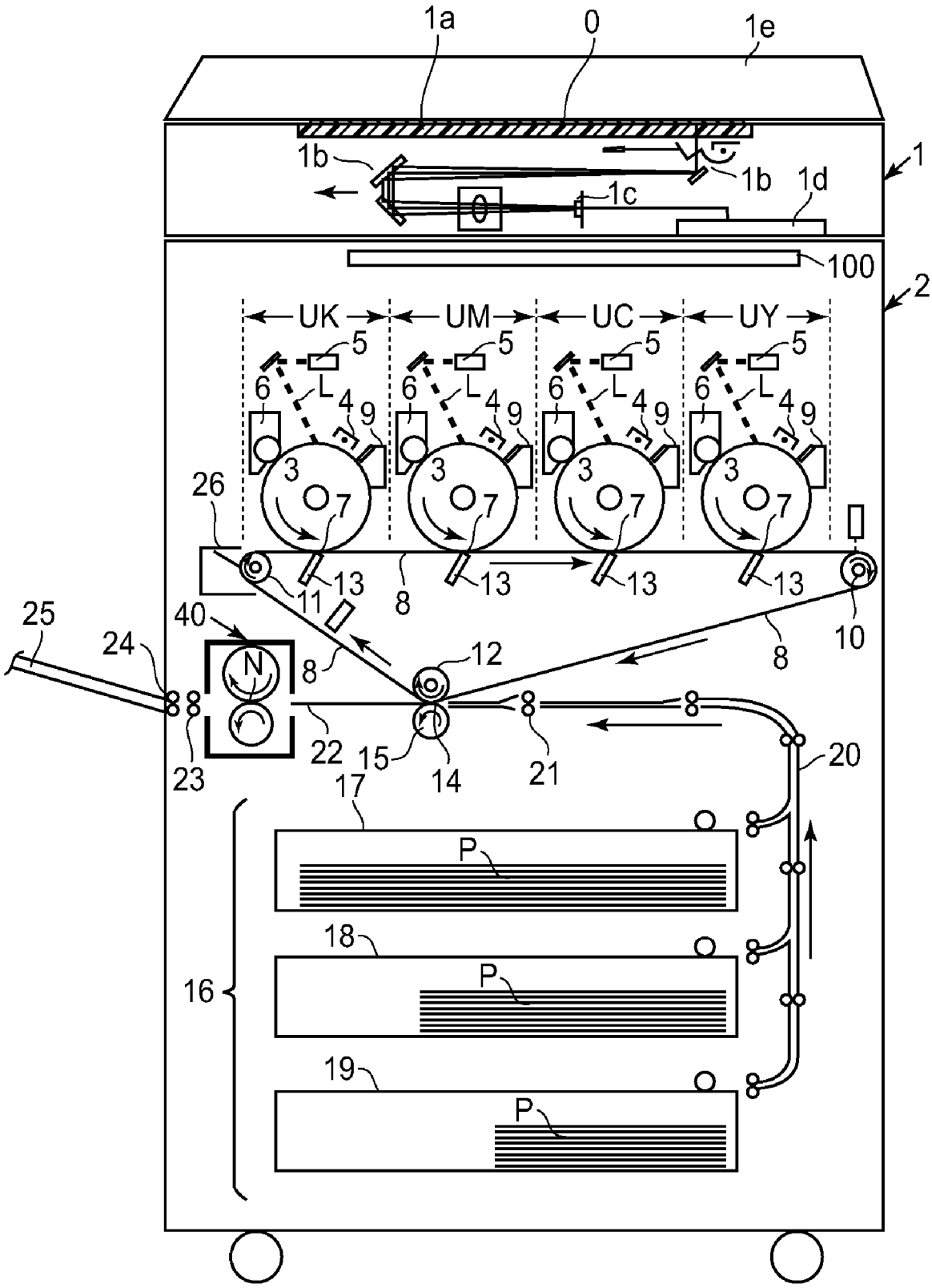
FIG. 1 is a vertical sectional view of the image forming apparatus in the first embodiment of the present invention, showing the general structure thereof.

FIG. 1 is a vertical sectional view of an electrophotographic full-color copying machine as an example of an image forming apparatus, the fixing apparatus of which is an image heating apparatus in accordance with the present invention. First, the general structure of the image forming apparatus will be described.

Designated by a reference numeral 1 is an image reading portion (digital color image reader). The image reading portion 1 photoelectrically reads an original O (color image) placed on its original placement glass platen 1*a*. More specifically, it scans the original O with a movable optical system 1*b*, separates the light reflected by original into primary colors, with its full-color sensor 1*c* (CCD), and outputs video signals (electrical signals), which correspond to the primary colors. The video signals are processed by the image processing portion, according to a preset sequence, and then, are sent to the control unit 100 of an image output portion (digital color image printer portion). Designated by a referential character 1*e* is an original pressing plate, or an automatic original feeding apparatus (ADF, RDF).

The control unit 100 plays the role of driving the various loads in the image forming apparatus, the role of analyzing the information from the sensors, and the role of exchanging data between the image output portion 2 and the control panel, that is, a user interface. All the operations carried out by this image forming apparatus are integrally controlled by this control unit 100.

The portions of the image output portion 2, which are designated with referential characters UK, UM, UC, and UY, are four image formation units, more specifically, first-fourth image formation units, which are disposed in tandem from left to right in the drawing, in the image output portion 2. The four image formation units are identical in structure, and each image formation unit constitutes an independent electrophotographic image formation mechanism which uses a laser-based exposing method.

Designated with a reference numeral 3 in each of the image formation units UK, UM, UC, and UY is an electrophotographic photosensitive member (which hereafter will be referred to as a drum), which is in the form of a drum. The drum 3 is rotationally driven in the counterclockwise direction, or the direction indicated by an arrow mark. Designated with a reference numeral 4 is a primary charging device for uniformly charging the peripheral surface of the drum 3, and designated with a reference numeral 5 is a laser based exposing device, which forms an electrostatic latent image by scanning (exposing) the uniformly charged peripheral surface of the drum 3 with a beam of laser light L modulated with the above-mentioned video signals obtained by separating the optical image of the original into the primary color. Designated with a reference numeral 6 is a developing apparatus for developing an electrostatic latent image on the peripheral surface of the drum 3 into a visible image, that is, an image formed of a toner (which hereafter will be referred to simply as a toner image). The developing apparatus 6 of the first image formation unit, or the image formation unit UK, holds black toner as a developer. The developing apparatus 6 of the second image formation unit, or the image formation unit UM, holds magenta toner. The developing apparatus 6 of the third image formation unit, or the image formation unit UC, holds cyan toner as a developer. The developing apparatus 6 of the fourth image formation unit, or the image formation unit UY, holds yellow toner.

The first image formation unit (UK) is controlled so that it forms a black toner image on the peripheral surface of the drum 3, with a preset control timing, in response to the video signals, which were obtained through the above-mentioned separation of the optical image of the original into the primary colors, and were sent to the control unit 100 of the image outputting portion 2 from the image processing portion 1*d* of the image reading portion 1. The second image formation unit UM is controlled so that it forms a magenta toner image on the peripheral surface of the drum 3 with a preset control timing. The third image formation unit UC is controlled so that it forms a cyan toner image on the peripheral surface of the drum 3 with a preset control timing. The fourth image formation unit UY is controlled so that it forms a yellow toner image on the peripheral surface of the drum 3 with a preset control timing.

The above-mentioned toner images formed on the peripheral surfaces of the drums 3 of the image formation units, one for one, are sequentially transferred in layers onto the surface of an intermediary transfer belt 8 (which hereafter will be referred to as belt 8), which is endless and flexible, and is being rotationally driven, in each of the primary transfer portions 7, one for one. As a result, a single unfixed full-color toner image is synthetically effected on the surface of the belt 8. The toner particles which failed to be transferred in each image formation unit and remain on the drum 3 are removed by a cleaning apparatus 9.

The belt 8 is suspended by being stretched around a driving roller 10, a follower roller 11, and a belt backing roller 12. The follower roller 11 also functions as a tension roller. The belt backing roller 12 is positioned so that it opposes a second transfer roller 15. The belt 8 is rotationally driven in the clockwise direction, or the direction indicated by an arrow mark in the drawing, at roughly the same velocity as the peripheral velocity of the drum 3. The belt 8 is disposed so that the portion of the belt 8, which is between the driving roller 10 and follower roller 11 in terms of the moving direction of the belt 8, opposes the downwardly facing portion of the peripheral surface of the drum 3, forming thereby first transferring portion 7, in each image formation unit. Designated with reference numerals 13 are primary transfer charging devices, which are disposed on the inward side of the loop which the belt 8 forms, and the positions of which correspond to the first transfer portions 7, one for one. During the first transfer of a toner image, a preset voltage is applied to the first transfer charging device 13.

The unfixed full-color image synthetically formed on the surface of the belt 8 is conveyed to a second transfer portion 14 by the subsequent circular rotational movement of the belt 8. The second transfer portion 14 is formed by pressing a second transfer roller 15 against the belt-backing roller 12, with the belt 8 pinched between the two rollers 15 and 12. That is, the nip between the second transfer roller 15 and belt 8 is the second transfer portion 14. To the second transfer portion 14, a sheet of recording medium P (transfer medium) is sent from the paper feeding unit 16, with a preset control timing. Then, the recording medium P is conveyed through the second transfer portion 14. While the recording medium P is conveyed through the second transfer portion 14, the unfixed full-color toner image on the belt 8 is transferred together (second transfer) onto the surface of the recording medium P in a manner of being peeled away from the belt 8. During the second transfer of the toner images, a preset voltage is applied to the second transfer roller 15.

The paper feeding unit 16 is provided with a multiple (three) paper feeder cassettes 17, 18, and 19, which are placed in the multiple paper feeder cassette bays, one for one, which are vertically stacked in the main assembly of the image forming apparatus. In an image forming operation, the recording mediums P in the paper feeder cassette selected according to recording medium size, or the like criterion, are fed into the main assembly of the image forming apparatus, with a preset control timing, while being separated one by one. After being fed into the apparatus main assembly, each recording medium P is conveyed to a pair of registration rollers 20, while being guided by a sheet passage 20. At the moment of the arrival of the recording medium P at the pair of registration rollers 21, the registration rollers 20 are stationary, and therefore, the leading edge of the recording medium P collides with the nip between the pair of registration rollers 21. Then, the rotational driving of the registration rollers 21 is started in synchronization with the starting of the image formation in the image formation units UK, UM, UC, and UY. The timing of the starting of the rotational driving of the registration rollers 21 is set so that the arrival of the toner images transferred (first transfer) onto the belt 8 by the image formation units, at the second transfer portion 14, coincides with the arrival of the recording medium P at the second transfer portion 14.

After the second transfer of the toner images onto the recording medium P, which occurs while the recording medium P is conveyed through the second transfer portion 14, the recording medium P is separated from the surface of the belt 8, and is precisely guided to the fixation nip N of a fixing apparatus 40 (fixation unit) by a recording medium conveyance guide 22. Then, the recording medium P is conveyed through the fixation nip N. While the recording medium P is conveyed through the fixation nip N, the toner images on the recording medium P are fixed to the surface of the recording medium P by the heat and pressure applied thereto in the nip N. After coming out of the fixation nip N of the fixing apparatus 40, the recording medium P is further conveyed, and then, is discharged from the apparatus main assembly, by the inward and outward pairs 23 and 24 of paper discharge rollers, onto a delivery tray 25 so that it cumulatively settles on the preceding recording mediums in the delivery tray 25.

Designated with a reference numeral 26 is a cleaning unit for cleaning the image formation surface of the belt 8. The toner particles which failed to be transferred onto the recording medium P in the second transfer portion 14, and therefore, remain on the belt 8, are removed by this cleaning unit 26.

(2) Fixing Apparatus 40

Figure 2:
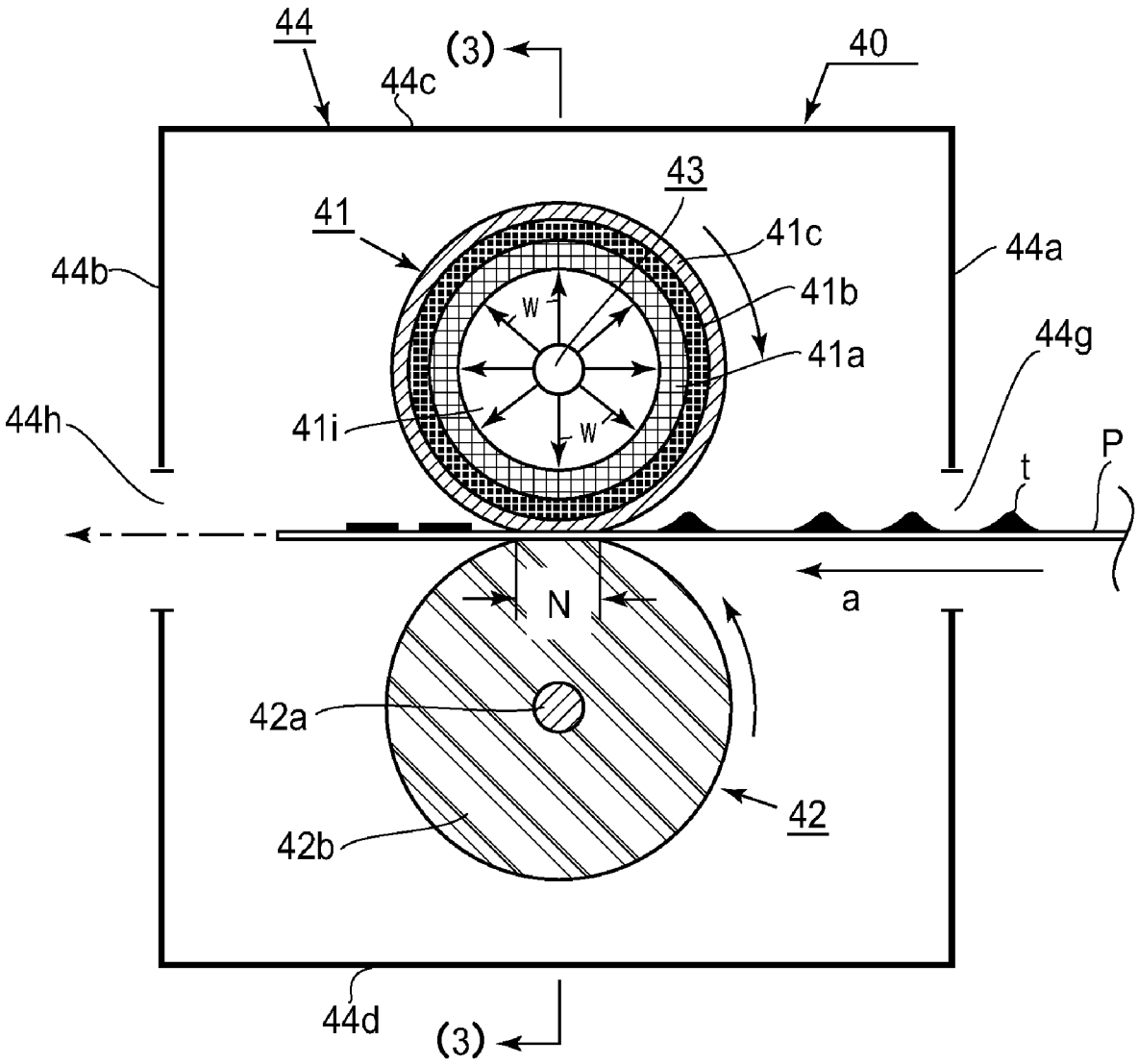
FIG. 2 is a cross sectional view of the fixing apparatus in the first embodiment of the present invention, showing the general structure thereof.
Figure 3:
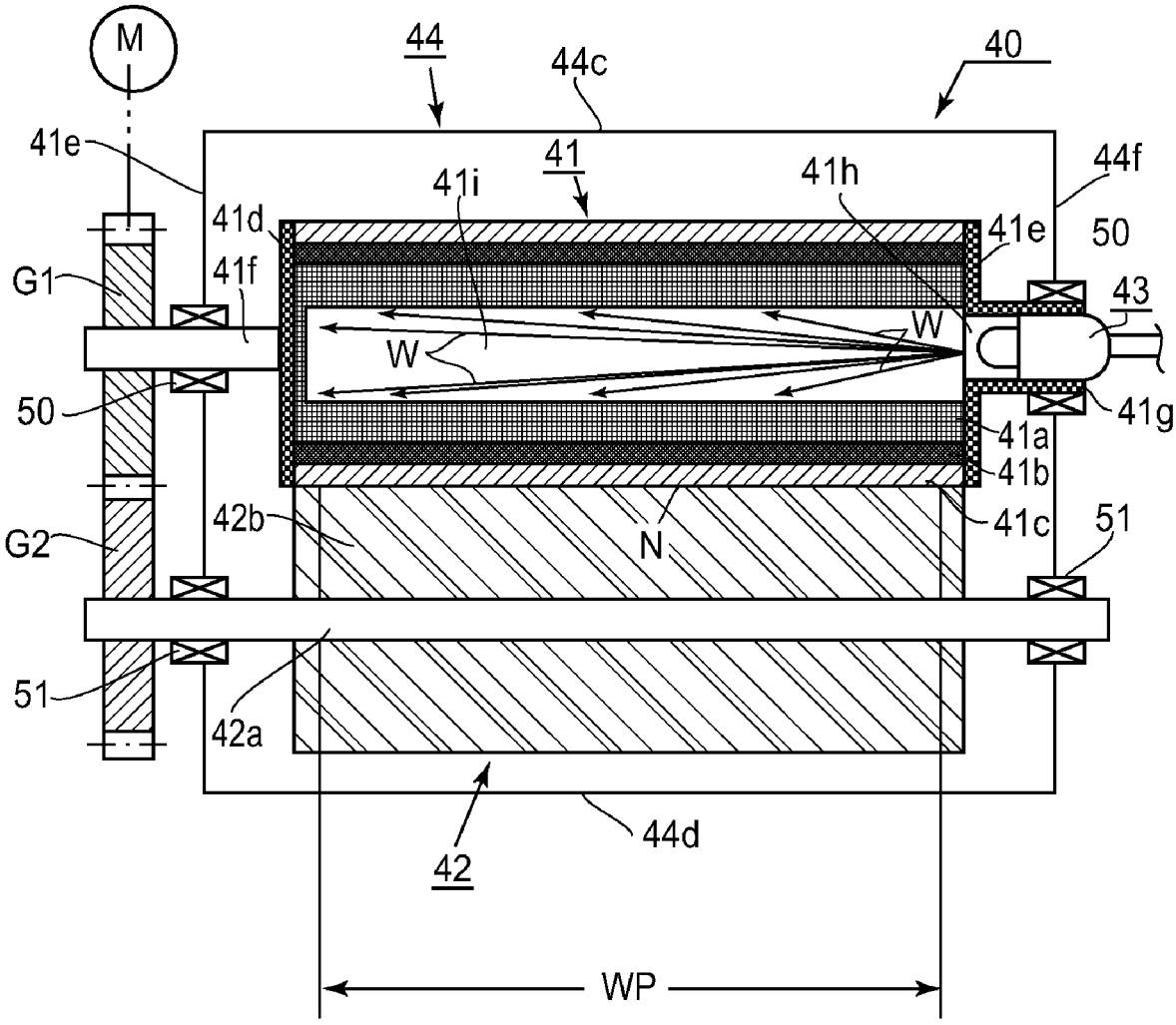
FIG. 3 is a vertical sectional view of the fixing apparatus shown in FIG. 2, at a line (3)-(3) in FIG. 2, as seen from the front side of the apparatus.
Figure 4:
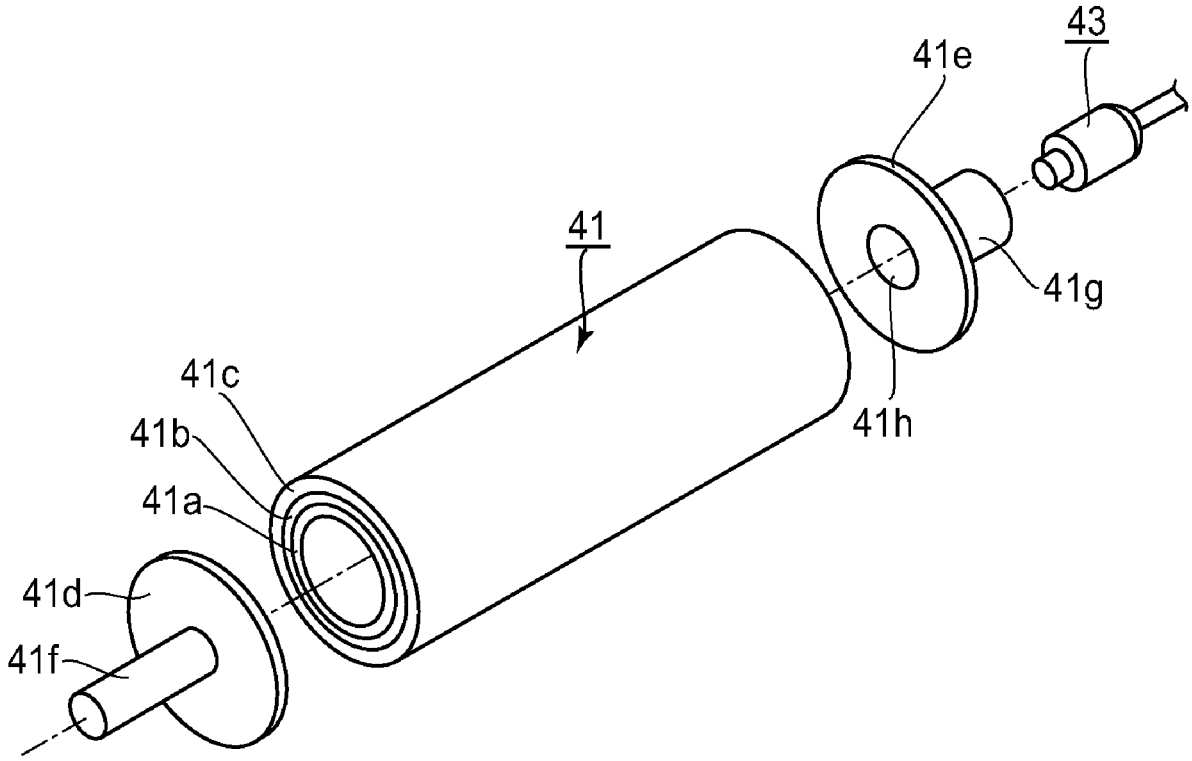
FIG. 4 is an exploded perspective view of the heat roller.

FIG. 2 is a cross sectional view of the fixing apparatus 40, as an image heating apparatus, in this embodiment, and shows the general structure of the fixing apparatus 40. FIG. 3 is a vertical sectional view of the fixing apparatus 40 in FIG. 2, at a line (3)-(3), as seen from the front side of the image forming apparatus. This fixing apparatus 40 is a microwave-based fixing apparatus, that is, a fixing apparatus which uses microwaves (electromagnetic waves of extremely high frequency) to heat its heat roller.

The lengthwise direction of the fixing apparatus 40 means the direction parallel to the axial line of its heat roller or pressure roller. The front side of the fixing apparatus 40 means the side which has the recording medium entrance. The left or right direction of the fixing apparatus 40 means the left or right direction of the fixing apparatus 40 as seen from the front side.

Designated with a reference numeral 41 is the heat roller (fixation roller), which is a rotational heating member.

Designated with a reference numeral 42 is the pressure roller, which is a rotational pressure applying member. The pressure roller 42 and the above-mentioned heat roller 41 form a fixation nip N, through which the recording medium P is conveyed while remaining pinched between the heat roller 41 and pressure roller 42. The pressure roller 42 is made up of a center shaft 42*a*, and a cylindrical elastic layer 42*b* fitted around the center shaft 42*a*.

The above-mentioned heat roller 41 and pressure roller 42 are disposed in a housing 44, which is in the form of a rectangular parallelepiped, which has six walls, more specifically, the front, rear, top, bottom, left, and right walls 44*a*-44*f*. The heat roller 41 and pressure roller 42 are disposed roughly in parallel, and are vertically juxtaposed, being kept pressed upon each other. The housing 44 is formed of a metallic plate, for example, an aluminum plate, a copper plate, a stainless steel plate, or the like, and the lengthwise direction of which is parallel to the lengthwise direction of the fixing apparatus 40. It is structured so that it surrounds the heat roller 41 and pressure roller 42. Metals such as aluminum, copper, stainless steel, and the like, are characterized in that they reflect microwaves, that is, therefore, being cable of blocking microwaves. The front wall 44*a* is provided with a recording medium entrance 44*g*, which is in the form of a slit. The slit is roughly centrally positioned relative to the front wall 44*a*, and extends in the lengthwise direction (left or right direction) of the housing 44. The rear wall 44*b* is provided with a recording medium exit 44*h*, which also is in the form of a slit. The slit is roughly centrally positioned relative to the rear wall 44*b*, and extends in the lengthwise direction of the housing 44.

The heat roller 41 has a cylindrical roller portion (roller proper), and a pair of microwave blocking plates 41*d* and 41*e*, which are solidly bonded to the left and right lengthwise ends of the cylindrical roller portion, respectively. The microwave blocking end plates 41*d* and 41*e* are in the form of a disc (flange disc). This cylindrical roller portion and the end plates 41*d* and 41*e* make up a microwave confinement container which prevents the microwaves guided into the heat roller (as will be described later), from leaking out of the heat roller, in practical terms.

The cylindrical roller portion is a multilayered portion, which is made up of a heat generation layer 41*a*, a shield layer 41*b*, and an elastic layer 41*c*, as listed from the inward side. These layers 41*a*, 41*b*, and 41*c* are airtightly bonded to the adjacent layers.

The heat generation layer 41*a*, or the most inward layer, remains in the solid state (nonfluidic) while its temperature is in a temperature range between the normal temperature and the high end of the proper temperature range for fixing a toner image. It is formed of a substance which generates heat in itself by absorbing electromagnetic waves, such as the microwaves generated by a microwave generating means. As will be described later, the heat generation layer 41*a* is the layer which generates heat by absorbing the microwaves w sent into the heat roller. In this embodiment, the heat generation layer 41*a* is a ceramic layer formed of silicon carbide, ferrite, silicon nitride, etc. More specifically, the powdery mixture of particulate silicon carbide, particulate ferrite, and a small amount of particulate silicon nitride, etc., is formed, with the use of a press, into a cylindrical body, the shape of which matches that of the heat roller, and then, the cylindrical body is sintered. As the material for the heat generation layer 41*a*, a substance which is high in a coefficient of dielectric loss is preferable, for example, silicon carbide, the coefficient of dielectric loss of which is no less than 0.3. In reality, as long as the heat generation layer 41*a* is no less than 0.2 in coefficient of dielectric loss, it can generate heat by an amount large enough to satisfactorily fix a toner image without reducing the recording medium conveyance speed of an image forming apparatus by which a fixing apparatus is employed.

Incidentally, a liquid such as water, alcohol, etc., also generates heat by absorbing microwaves, and therefore, is possibly usable as the material for the heat generation layer of the heat roller for a fixing apparatus. However, in order for a liquid to effectively absorb microwaves, the amount of liquid must be greater than a certain value. Therefore, liquid is not suitable for realizing a small apparatus. Further, the temperature of a liquid cannot be increased beyond its boiling point, and the container in which liquid can be sealed is complicated in structure. Moreover, should the container is be damaged, the liquid in the container might leak and affect the adjacent mechanisms and apparatuses. Therefore, the material for the heat generation layer 41*a* is desired to be such a substance that remains in the solid state (nonfluidic), at least in the temperature range between the normal temperature and the high end of the proper temperature range for the fixation of a toner image.

The shield layer 41*b*, or the layer on the immediately outward side of the above-mentioned heat generation layer 41*a*, is a metallic layer formed of aluminum, copper, stainless steel, or the like, which reflects microwaves. A substantial amount of the microwaves w sent into the heat roller is absorbed by the heat generation layer 41*a*. However, it is possible that a certain amount of the microwaves w sent into the heat roller will transmit through the heat generation layer 41*a*; it will leak from the heat roller 41. It is also possible that microwaves w may leak from the heat roller 41 through the gaps of the heat generation layer 41*a*. The shield layer 41*b* plays the role of preventing microwaves from penetrating through the heat generation layer 41*a* from an inward side of the heat generation layer 41*a*.

Incidentally, all that is required of the shield layer 41 is to block such microwaves that are greater in intensity than 100 $mW/cm^2$. That is, in this embodiment, the statement that the shield layer 41*b* "blocks microwaves" means that the shield layer 41*b* blocks at least such microwaves that are no less in intensity than "100 $mW/cm^2$". This statement also applies to the description of the end plates 41*d* and 41*e* which are also required to block microwaves. The end plates 41*d* and 41*e* will be described later.

Not only does a metallic substance such as aluminum and stainless steel reflect (and therefore, block) microwaves as described above, but also, it is relatively high in thermal conductivity. Therefore, using a metal such as aluminum and stainless steel can make the heat roller 41 uniform in temperature distribution in terms of circumferential as well as lengthwise directions, and therefore, makes it possible to yield a copy superior in fixation.

The elastic layer 41*c*, or the outermost layer of the heat roller 41, plays the role of allowing the heating surface of the heat roller 41 to accommodate the unevenness of the recording medium P and the unevenness of a toner image t so that the heating surface airtightly contacts the surface of the recording medium P to achieve a satisfactory level of fixation as well as a satisfactory level of glossiness. That is, the heat roller 41 directly heats toner. Therefore, the surface properties of the heat roller 41, in particular, the hardness of the surface of the heat roller 41, etc., affect the level of fixation. Therefore, the heat roller 41 is provided with the elastic layer 41*c* as necessary.

The end plates 41*d* and 41*e* are attached to the end surfaces of the cylindrical roller portion of the heat roller 41 so that they seal the openings of the lengthwise left and right ends of the cylindrical roller portion. They are formed of a metal such as aluminum, copper, stainless steel, etc., which is capable of blocking electromagnetic waves, such as the microwaves w sent into the heat roller, by reflecting them.

The left end plate 41*d* is provided with a shaft 41*f*, which is integral with the left end plate 41*d* and perpendicularly protrudes outward from the center of the outward surface of the left end plate 41*d*. The right end plate 41*e* is provided with a cylindrical portion 41*g*, which is integral with the right end plate 41*e* and perpendicularly protrudes from the center of the outward surface of the right end plate 41*e*. The axial line of the shaft 41*f* of the left end plate 41*d* and the axial line of the cylindrical portion 41*g* of the right end plate 41*e* roughly coincide with the axial line of the cylindrical roller portion of the heat roller 41.

The heat roller 41 is rotationally supported by the left and right walls 44*e* and 44*f* of the housing 44. More specifically, the shaft 41*f* of the left end plate 41*d* and the cylindrical portion 41*g* of the right end plate 41*e* are supported by a pair of bearing members 50 placed between the shaft portion 41*f* and the left wall 44*e*, and between the cylindrical portion 41*g* and wall 44*f*, respectively. The pressure roller 42 is rotationally supported by the left and right walls 44*e* and 44*f* of the housing 44, by the left and right end portion of its center shaft 42*a*, with a pair of bearings 51 placed between the left and right end portions of the center shaft 42*a*, and left and right walls 44*e* and 44*f*, respectively. The heat roller 41 and pressure roller 42 are kept pressed upon each other with an unshown pressure applying means, against the elasticity of the elastic layers 41*c* and 42*b* of the two rollers 41 and 42, forming thereby a fixation nip N, which has a preset width in terms of the recording medium conveyance direction a.

The left shaft portion 41*f* of the heat roller 41 is rendered long enough to extend outward of the housing 44, beyond the bearing member 50. The end portion of the shaft portion 41*f* of the heat roller 41 is fitted with a heat roller gear G1, which is solidly attached to the shaft portion 41*f*. The left end portion of the center shaft 42*a* of the pressure roller 42 is rendered long enough to extend outward of the housing 44, beyond the bearing member 51. To the end portion of the left end portion of the center shaft 42*a*, a pressure roller gear G2 is solidly attached. The gears G1 and G2 are meshed with each other. As the rotational force from the fixing apparatus motor M is transmitted to the gear G1 through an unshown gear train, the heat roller 41 is rotationally driven by the transmitted force in the clockwise direction, or the direction indicated by an arrow mark in FIG. 2. Thus, the pressure roller 42 is rotationally driven by the rotation of the heat roller 41 in the counterclockwise direction, or the direction indicated by another arrow mark in FIG. 2. The gear ratio between the gears G1 and G2 is set so that the peripheral velocity of the heat roller 41 in the fixation nip N is roughly the same as that of the pressure roller 42 in the fixation nip N.

The cylindrical portion 41*g* of the heat roller 41, which functions as the right shaft for the heat roller 41, is fitted with a microwave generating device 43 for generating microwaves. The microwave generating device 43 is disposed in the cylindrical portion 41*g*. More specifically, the microwave generating device 43 is inserted into the hollow of the cylindrical portion 41*g*, and is non-rotationally held therein, with virtually no contact between the internal surface of the cylindrical portion 41*g* and the microwave generating device 43, using an unshown holding member.

The microwave generating device 43 is enabled to generate microwaves, the frequency of which is in the ISM (industrial, scientific, and medical) range, that is, the frequency range defined in the international treaty for the so-called ISM apparatuses, that is, industrial, scientific, and medical radio frequency apparatuses. In this embodiment, a magnetron which is capable of generating microwaves, the frequency of which is 2.45 GHz, is used as the microwave generating device 43.

The microwaves w generated by the microwave generating device 43 is sent into (applied to) the hollow 41*i* (microwave container), from the inward opening 41*h*, as the entrance, of the cylindrical portion 41*g* in which the microwave generating device 43 is located.

The lengthwise ends of the heat roller 41 in terms of the axial direction of the heat roller 41 are sealed with the end plates 41*d* and 41*e*, which are formed of a metallic substance, such as aluminum, copper, stainless steel, or the like, which reflects microwaves, being therefore effective to block microwaves. Therefore, the microwaves w is are prevented from leaking from the lengthwise ends of the heat roller 41 in terms of the axial direction of the heat roller 41. That is, the microwaves w sent into the hollow 41*i* of the heat roller 41 are prevented from leaking out of the heat roller 41 through the lengthwise ends of the heat roller 41. The end plates 41*d* and 41*e* located at the lengthwise ends of the heat roller 41 in terms of the direction parallel to the axial line of the heat roller 41 are desired to be low in thermal capacity and thermal conductivity, from the standpoint of minimizing the thermal capacity of the heat roller 41.

The end plates 41*d* and 41*e* are attached to the ends of the heat roller 41, in terms of the direction parallel to the rotational axis of the heat roller 41, to reduce the gaps which allow microwaves to leak, so that the ends of the heat roller 41 are satisfactorily sealed to prevent the microwave leakage.

Figure 5:
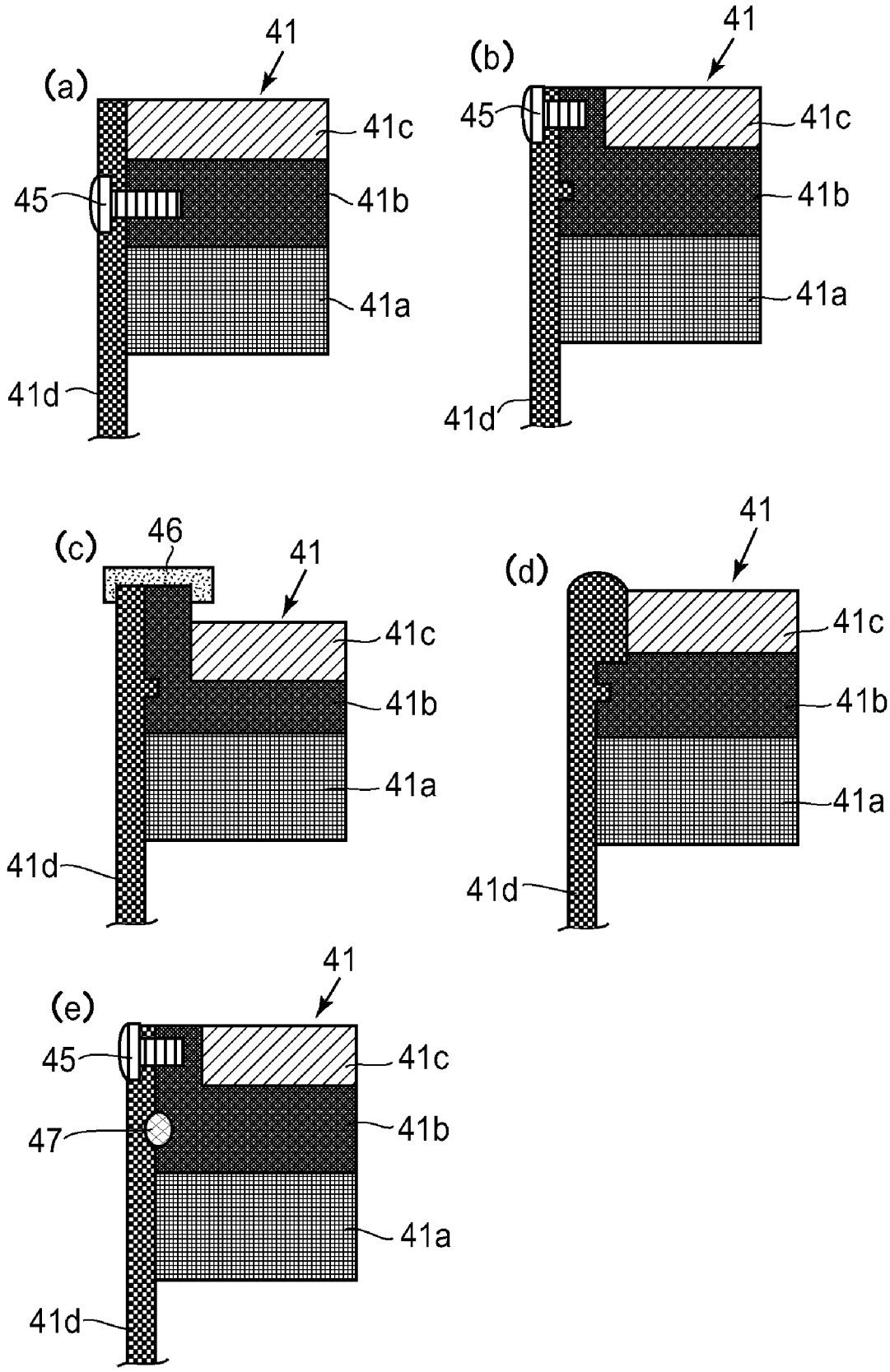
FIGS. 5(*a*)-5(*e*) are sectional views of the lengthwise left end portions of various heat rollers, different in the structural arrangement for attaching the left end plate to the lengthwise left end of the cylindrical portion of the heat roller, showing the structural arrangements thereof.

FIGS. 5(*a*)-5(*e*) show various examples, one for one, of the structural design for attaching the end plates 41*d* (41*e*) to the corresponding lengthwise end of the cylindrical roller portion of the heat roller 41. Although each drawing shows the structural design for attaching the left end plate 41*d* to the left end of the cylindrical roller portion of the heat roller 41, the structural design for attaching the right end plate 41*e* to the right end of the cylindrical roller portion is similar to that for the left end plate 41*d*. Here, "left" or "right" end means one of the lengthwise ends of the heat roller 41, and the other, in terms of the direction of the rotational axis of the heat roller 41.

In the case of the design shown in FIG. 5(*a*), the end plate 41*d* is attached to the cylindrical roller portion by screwing a small screw 45 into the shield layer 41*b* of the cylindrical roller portion. The small screw 45 may be screwed into the heat generation layer 41*a*.

In the case of the design shown in FIG. 5(*b*), the lengthwise end of the shield layer 41*b* of the cylindrical roller portion is provided with a flange-like portion, which is to be parallel to the end plate 41*d*, and the end plate 41*d* is attached to the cylindrical roller portion by screwing a small screw 45 into the flange like portion of the shield layer 41*b*.

In the case of the design shown in FIG. 5(*c*), the lengthwise end of the shield layer 41*b* of the cylindrical roller portion is provided with a flange-like portion, which is to be parallel to the end plate 41*d* and extends beyond the peripheral surface of the elastic layer 41*c*. Then, the end plate 41*d* is attached to the cylindrical roller portion by clamping together the end plate 41*d* and the flange-like portion of the shield layer 41*b* with the use of a clamping member 46.

In the case of the design shown in FIG. 5(*e*), the end plate 41*d* is attached to the shield layer 41*b* of the cylindrical roller portion by crimping the end plate 41*d*. Although not shown in the drawing, the gaps can be minimized by welding the end piece in advance, or giving the like treatment.

In the case of the design shown in FIG. 5(*e*), the lengthwise end of the shield layer 41*b* of the cylindrical roller portion is provided with a flange-like portion, which is to be parallel to the end plate 41*d*, and the end plate 41*d* is attached to the cylindrical roller portion by screwing a small screw 45 into the flange-like portion of the shield layer 41*b*, with a ring 47, or the like, formed of a microwave absorbing substance sandwiched between the end plate 41*d* and the shield layer 41*b* or heat generation layer 41*a*. The small screw 45 may be screwed into the heat generation layer 41*a*. This structural design is more effective to prevent the microwave leakage than the preceding designs.

The structural design for attaching the end plates 41*d* and 41*e* to the left and right lengthwise ends, respectively, of the cylindrical portion of the heat roller 41 does not need to be limited to those described above, as long as the microwave leakage can be satisfactorily prevented.

With the attachment of the left and right end plates 41*d* and 41*e* formed of a substance impenetrable by microwaves, to the lengthwise ends of the cylindrical portions, one for one, and the provision of the above-mentioned shield layer 41*b* on the outward side of the heat generation layer 41*a*, make it possible to keep below a preset value, the amount by which the microwaves w sent into the hollow 41*i* of the heat roller 41 leaks out of the heat roller 41.

The amount by which electromagnetic waves, such as microwaves, leak from the heat roller 41 is desired to be such that the intensity of the microwaves measured on the outward sides of the microwave shields 41*d*, 41*e*, and 41*b* is no more than 100 mW/cm$^2$, preferably, 10 mW/cm$^2$, more preferably, 5 mW/cm$^2$. Even if the above-described structural designs cannot satisfactorily prevent the microwave leakage, the portion of the microwaves, which will leak out of the heat roller 41, will be satisfactorily weak in intensity. Therefore, all that is necessary is to surround the heat roller 41 with microwave absorbing members so that the amount of microwave energy measured outside the image forming apparatus is no more than 100 mW/cm$^2$.

Figure 6:
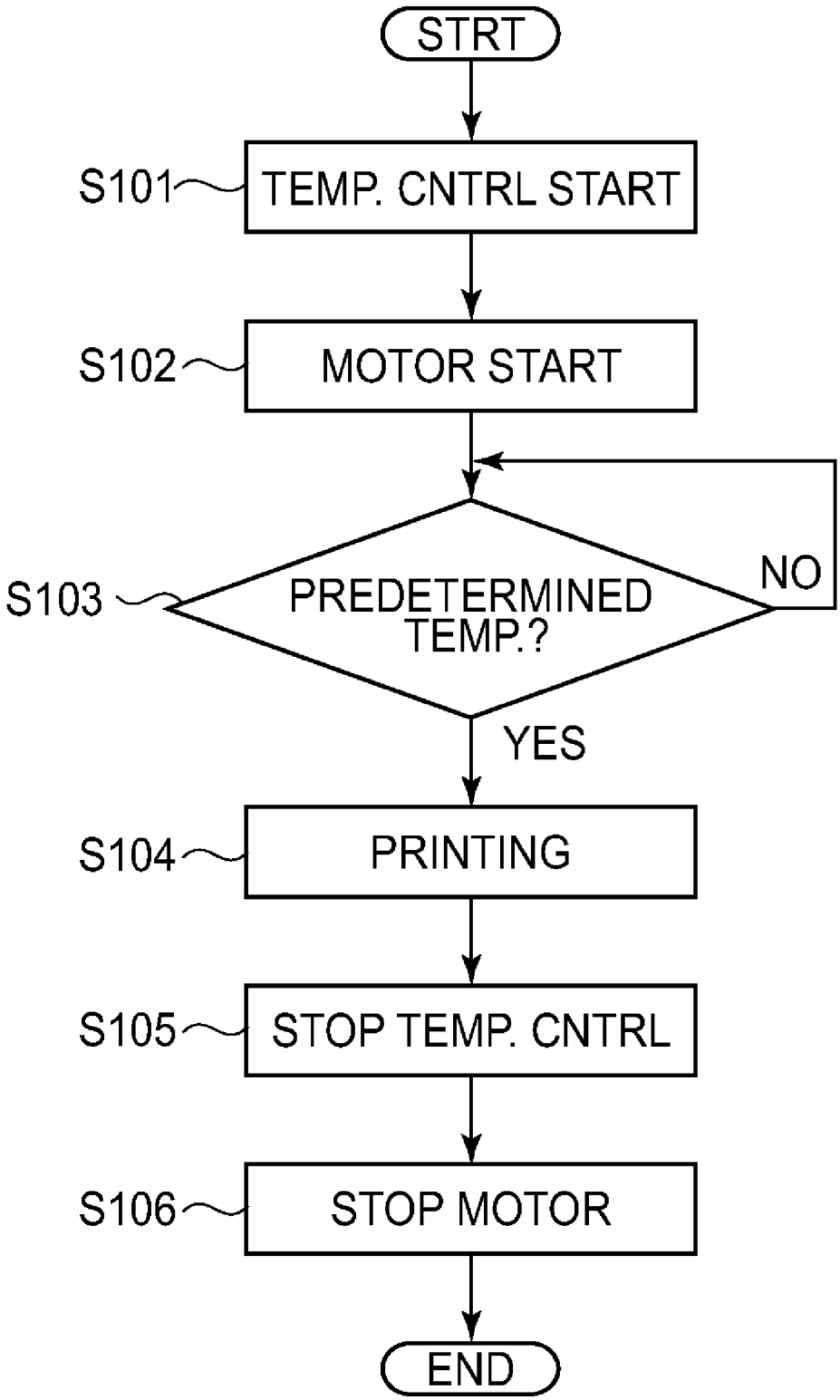
FIG. 6 is a flowchart of the operation of the fixing apparatus in the first embodiment of the present invention.
Figure 7:
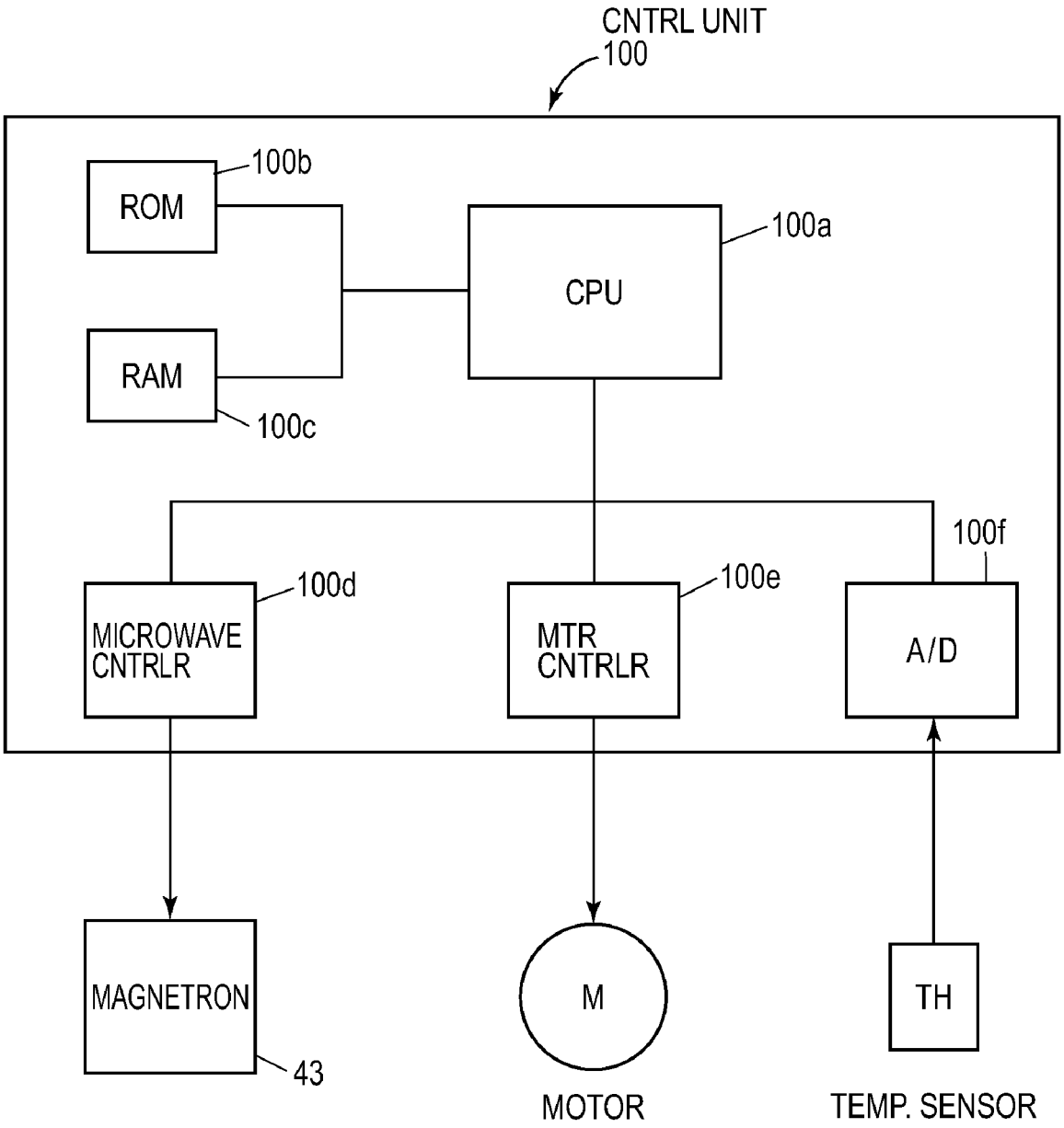
FIG. 7 is a block diagram of the temperature control system of the fixing apparatus.

As an image forming operation start signal is issued, the above-described fixing apparatus is controlled by the control unit 100. FIG. 6 is a flowchart of the operation of the fixing apparatus 40. FIG. 7 is a block diagram of the temperature control system of the fixing apparatus 40.

Referring to FIG. 6, as the image forming apparatus is turned on, the control unit 100 turns on the microwave generating device 43 of the fixing apparatus 40, and begins to control the temperature of the fixing apparatus (S101). Next, it begins to drive the fixing apparatus motor M (S102). As the temperature of the heat roller 41 of the fixing apparatus 40 reaches a preset level, it allows a printing operation to be carried out (S104).

The heat roller 41 is heated by the heat which the heat generation layer 41*a* generates by absorbing the microwaves w sent into the hollow 41*i* of the heat roller 41 from the microwave generating device 43. This heat generated by the heat generation layer 41*a* is transmitted to the shield layer 41*b* and elastic layer 41*c*, which are on the outward side of the heat generation layer 41*a*, heating thereby the shield layer 41*b* and elastic layer 41*c*. Therefore, the heat roller 41 quickly heats up, roughly uniformly in terms of its lengthwise direction as well as circumferential direction. The temperature of the heat roller 41 is controlled throughout the printing operation so that the temperature of the heat roller 41 of the fixing apparatus 40 remains constant (at a fixation level) throughout the printing operation.

As soon as the job, such as copying an original or the like, printing operation, set up for the image forming apparatus is completed, the control unit 100 turns off the microwave generating device 43, and stops controlling the temperature of the heat roller 41 (S105). Then, it stops driving the fixing apparatus motor M (S106).

Referring to FIG. 7, the control unit 100 has a CPU 100*a*, which carries out various sequences related to preset image formation sequences, following the programs stored in the ROM 100*b* with which the control unit 100 is provided. The control unit 100 is also provided with a RAM 100*c* for storing rewritable data which need to be temporarily or permanently stored to carry out the above-mentioned sequences. Further, the control unit 100 is provided with a microwave controlling portion 100*d*, which controls the microwave generating device 43 (magnetron), and a motor controlling portion 100*e* which controls the fixing apparatus motor M. The microwave controlling portion 100*d* includes a high voltage control circuit, a filament voltage control circuit, etc., which are necessary for the operation of the microwave generating device 43. The control portions 100*d* and 100*e* are controlled by the CPU 100*a*.

The electrical information regarding the surface temperature of the heat roller 41, which is detected by an unshown temperature sensor TH, is inputted into the CPU 100*a* through an A/D converter 100*f*. That is, the analog signals outputted from the temperature sensor TH in response to the changes in the surface temperature of the heat roller 41 are converted into digital signals, and then, are inputted into the CPU 100*a*, by the A/D converter 100*f*. Based on these temperature data, the CPU 100*a* turns on or off the microwave generating device 43 by controlling the microwave control portion 100*d*, to control the temperature of the heat roller 41, that is, the temperature of the fixing apparatus.

The heat roller 41 and pressure roller 42 are rotationally driven. While the surface temperature of the heat roller 41 is controlled so that it remains at the preset fixation level, the recording medium P, which is bearing an unfixed toner image on its top surface, is introduced into the fixing apparatus 40 through the recording medium entrance 41*g*, from the second transfer portion 14 side. Then, the recording medium P is advanced into the fixation nip N, or the compression nip between the heat roller 41 and pressure roller 42, and is conveyed through the fixation nip N while remaining pinched between the heat roller 41 and pressure roller 42. While the recording medium P is conveyed through the fixation nip N while remaining pinched by the two rollers 41 and 42, the unfixed toner image on the recording medium P is fixed to the surface of the recording medium P by the heat from the heat roller 41 and the pressure applied from the pressure roller 42, in the fixation nip N. In other words, in order to fix the unfixed toner image, not only is the unfixed toner image melted by the heated heat roller 41, but also, it is subjected to the pressure applied by the pressure roller 42. Therefore, the fixation of the unfixed toner image yields a glossy permanent toner image. As the recording medium P is conveyed out of the fixation nip N, it is separated from the peripheral surface of the heat roller 41, and then, is sent out of the fixing apparatus 40 through the recording medium exit 44*h*. A referential character WP in FIG. 9 stands for the maximum recording medium width, which the fixing apparatus 40 can accommodate.

Incidentally, in this embodiment, a magnetron capable of generating microwaves which are 2.45 GHz in frequency is employed as a generating device 43 of the fixing apparatus 40. However, the choice of the microwave generating device does not need to be limited to the one employed in this embodiment. For example, an oscillator capable of generating high frequency waves, the frequency of which is roughly 30 GHz, may be employed. If such an oscillator is employed, the shield layer and end plates are desired to be structured so that they can block the high frequency waves generated by such an oscillator.

In this embodiment, the microwaves w generated by the microwave generating device 43 are sent into the heat roller 41 from one of the lengthwise ends of the heat roller 41 of the fixing apparatus 40. The internal surface of the heat roller 41 (heat generation layer 41*a*) may be directly irradiated with the microwaves w, as shown in FIGS. 2 and 3, or through an unshown microwave guiding tube. The lengthwise end of the heat roller 41, from which the microwaves w is sent into the heat roller 41, is provided with the microwave blocking member 41*e* (right end plate 41*e*) so that the microwaves sent into the hollow of the heat roller 41 is kept sealed therein even during the rotation of the heat roller 41, and so is the other lengthwise end of the heat roller 41, with the microwave blocking member 41*d* (left end plate 41*d*). The microwave blocking members 41*d* and 41*e* attached to the lengthwise ends of the heat roller 41, one for one, are desired to be low in thermal conductivity, in order to minimize the thermal capacity of the heat roller 41.

The heat roller 41 in this embodiment is provided with the shield layer 41*b* and elastic layer 41*c*, which are layered on the outward side of the heat generation layer 41*a*. Thus, the heat generated by the heat generation layer 41*a* is transmitted through the shield layer 41*b* and elastic layer 41*c*, which are thermal conductive layers. It is by this heat conducted through these thermally conductive layers that the recording medium P is heated. However, the provision of the shield layer 41*b* and/or elastic layer 41*c* is not mandatory; they may be added as necessary. That is, it is possible to employ a heat roller which does not have the shield layer 41*b* and elastic layer 41*c*. If such a heat roller is employed, the heat generation layer 41*a* itself is placed in contact with the recording medium P, and the recording medium P is heated by the heat which comes directly from the heat generation layer 41*a*.

In this embodiment, the microwaves are sent into the hollow of the cylindrical roller portion from one of the lengthwise end of the heat roller 41. However, the choice of the system for sending the microwaves into the hollow of the cylindrical roller portion does not need to be limited to the one in this embodiment, as long as it is only from the internal surface side of the heat generation layer 41*a* that the heat generation layer 41*a* is irradiated with the microwaves.

The heat roller 41 and pressure roller 42 may be provided with a recording medium releasing layer, as the outermost layer, which is formed of fluorinated resins or the like.

The pressure roller 42 as a pressure applying means may also be provided with multiple layers inclusive of a heat generation layer, as is the heat roller 41, so that it can be heated to a preset temperature level with microwaves.

As described above, in this embodiment, the heat generation layer 41*a* of the cylindrical roller portion of the heat roller 41, which generates heat by absorbing microwaves, is formed as the most inward layer of the cylindrical roller portion. Microwaves are sent into the hollow of the heat roller 41 so that the microwaves are reflected and absorbed by the heat generation layer 41*a*. Further, the cylindrical roller portion of the heat roller 41 is provided with the shield layer, and its lengthwise ends are covered with the end plates, one for one, which block microwaves. Therefore, it is possible to provide a microwave based thermal fixing apparatus (image heating apparatus) which leaks virtually no microwaves.

Embodiment 2

Next, the second embodiment of the present invention will be described. The structural members of the fixing apparatus in this embodiment, and the parts of the structural members, which are common with those in the first embodiment, will be given the same referential characters, and will not be described, to avoid repetition of the same descriptions.

Figure 8:
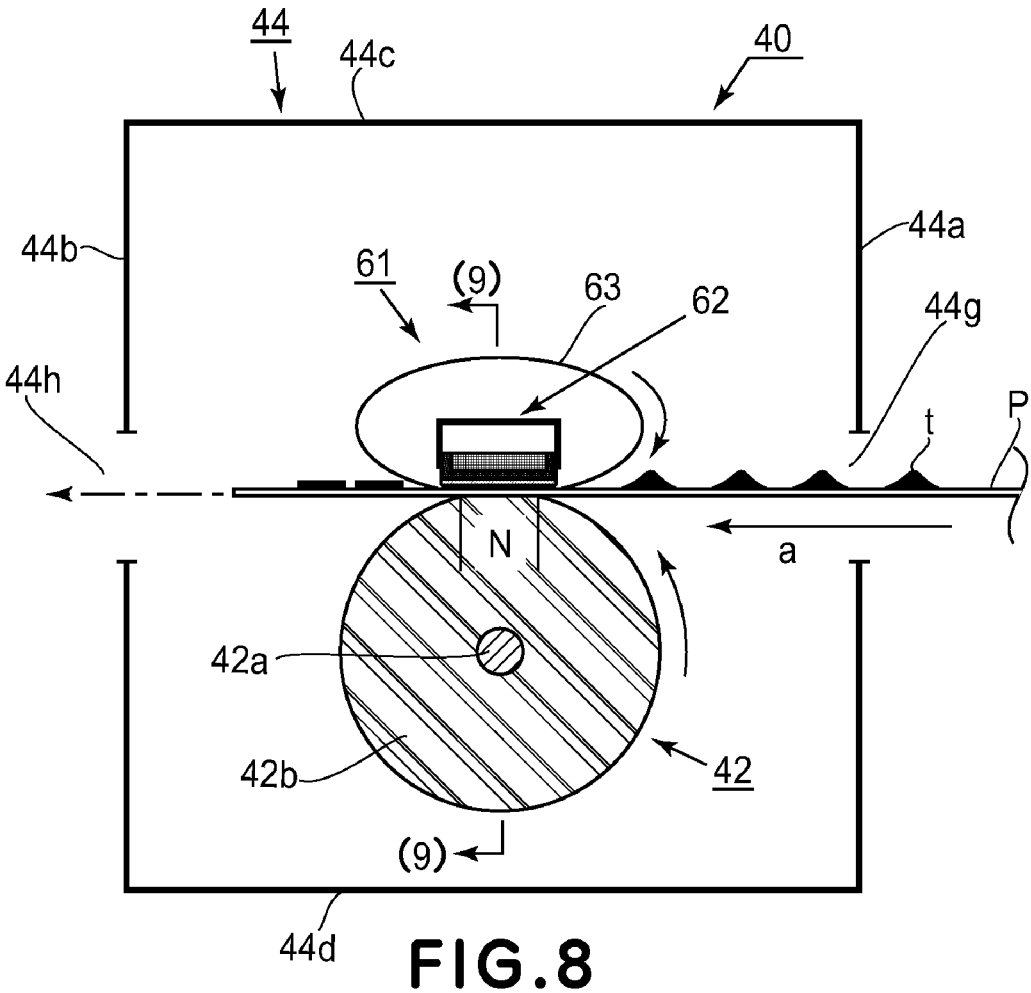
FIG. 8 is a cross-sectional view of the fixing apparatus in the second embodiment of the present invention, showing the general structure thereof.
Figure 10:
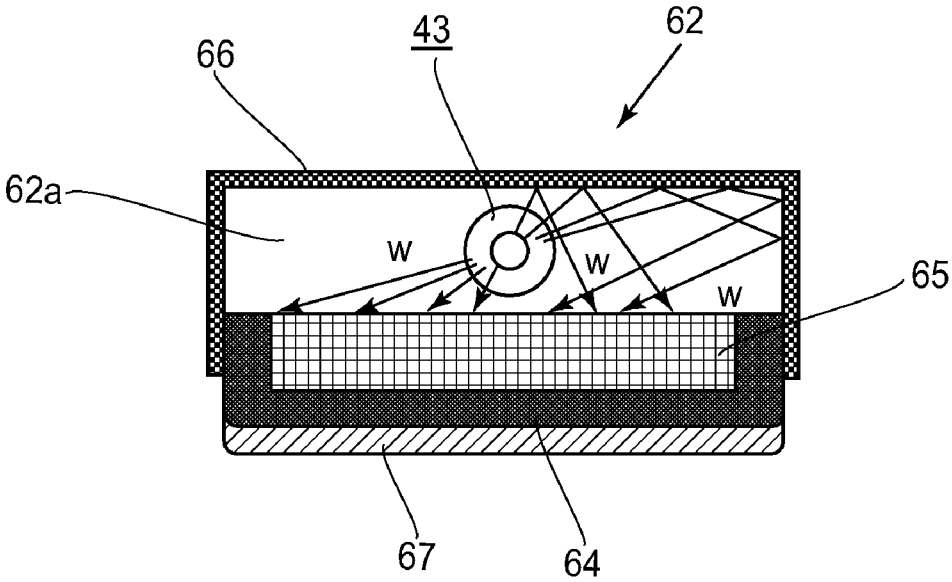
FIG. 10 is an enlarged cross-sectional view of the heater assembly.
Figure 9:
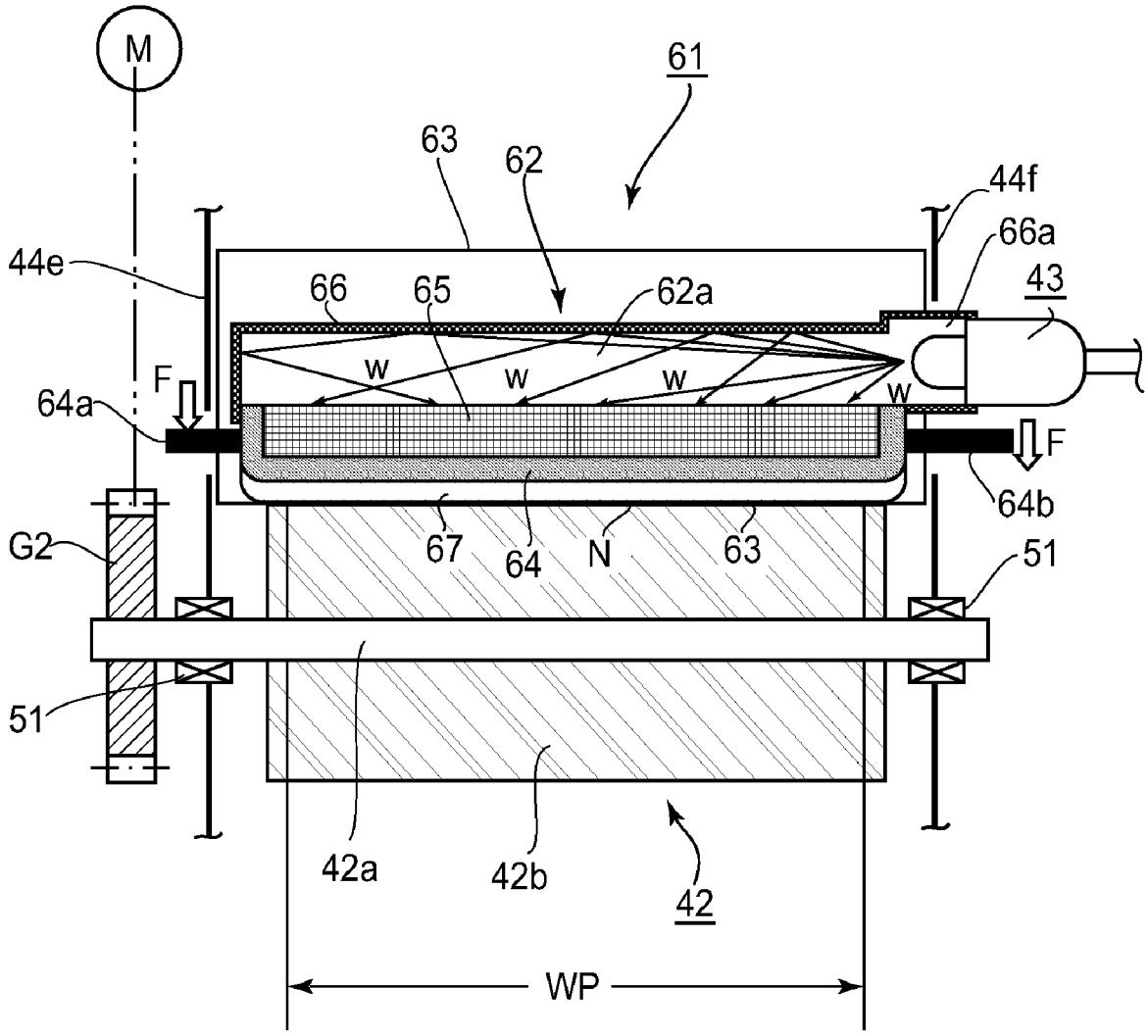
FIG. 9 is a vertical sectional view of the fixing apparatus shown in FIG. 8, at a line (9)-(9) in FIG. 8, as seen from the front side of the apparatus.
Figure 11:
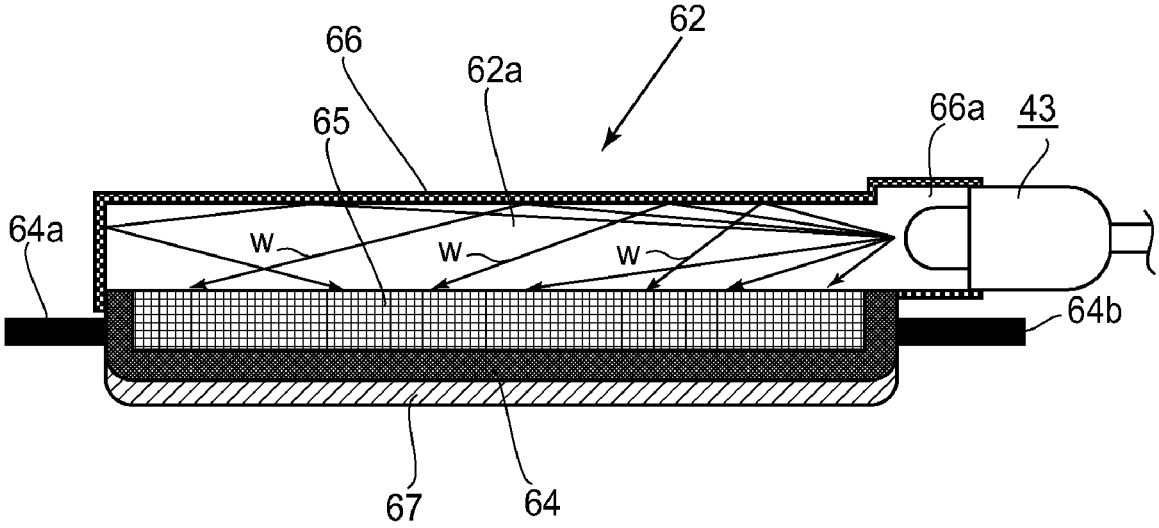
FIG. 11 is an enlarged vertical sectional view of the heater assembly.

FIG. 8 is a cross sectional view of the fixing apparatus 40 in this embodiment, and shows the general structure of the fixing apparatus 40. FIG. 9 is a vertical sectional view of the fixing apparatus in this embodiment, at a line (9)-(9) in FIG. 8, as seen from the front side of the fixing apparatus 40. FIGS. 10 and 11 are enlarged vertical and cross sectional views, respectively, of the heater assembly.

A pressure roller 42, as a pressure applying means, in this embodiment, is also rotationally supported by the left and right side walls 44*e* and 44*f* of the housing 44, as is the pressure roller 42 of the fixing apparatus 40 in the first embodiment. More specifically, the pressure roller 42 is provided with a center shaft 42*a*, and the left and right side walls 44*e* and 44*f* are provided with a pair of bearing members 51, one for one. The left and right end portions of the center shaft 52*a* are supported by the pair of bearing members 51, one for one. In this embodiment, the rotational force of the fixing apparatus motor M is transmitted to the gear G2 of this pressure roller 42 so that the pressure roller 42 is rotated in the counterclockwise direction, or the direction indicated by an arrow mark in FIG. 8.

The fixing apparatus 40 is provided with a heating unit 61 as a heating means, which is located on the top side of the pressure roller 42, in parallel to the pressure roller 42. The heating unit 61 has a heater assembly 62 and a heating belt 64 (heating film), which is a circularly moving heating member. The heating belt 64 is loosely fitted around the heater assembly 62. It is a flexible, endless, and heat resistant member, or a cylindrical heat resistant member. It is formed of heat resistant resin, heat resistant metal, or heat resistant resin-metal composite.

Members of heater assembly 62, which are designated with reference numerals 64 and 66 are microwave blocking bottom and top members, the lengthwise direction of which is parallel to the axial line of the pressure roller 42. The microwave blocking bottom and top members 64 and 66 (which hereafter will be referred to as bottom and top shields) are held to each other with small screws, by welding, by interlocking, or by the like method, forming thereby a hollow container, the lengthwise direction of which is parallel to the axial line of the pressure roller 42. The bottom and top shields 64 and 66 reflect microwaves. They are metallic members formed of a metal, such as aluminum, copper, stainless steel, or the likes metallic substance, which reflects microwaves. On the inward side of the bottom shield 64, a heat generating member 65, which generates heat by absorbing microwaves, is located. In this embodiment, the heat generating member 65 is a ceramic member formed by sintering a rod formed by press molding a mixture of silicon carbide, ferrite, and a small amount of powdery substance such as silicon nitride. Located between the heat generating member 65 and the top shield 66 is the space 62*a* into which microwaves are sent. The lengthwise right end of the top shield 66 is provided with a cylindrical hole 66*a*, in which the microwave generating device 43 (magnetron) is located, which was inserted into the cylindrical hole 66*a* through the outward opening of the cylindrical hole 66*a*. The left and right lengthwise ends of the bottom shield 64 are provided with extensions 64*a* and 64*b*, respectively, which extend outward in the lengthwise direction of the bottom shield 64. The extensions 64*a* and 64*b* are where force is applied to keep the bottom shield 64 upon the pressure roller 42. The downwardly facing surface of the bottom shield 64 is covered with a layer 67 of lubricous substance (lubricous layer) to minimize the friction between the inward surface of the heating belt 63 and the bottom shield 64. The lubricous layer 67 is a heat resistant layer, the coefficient of friction of which relative to the inward surface of the heating belt 63 is smaller than the coefficient of friction between the bottom shield 64 and the inward surface of the heating belt 63. It is formed of fluorinated resin, or glass.

The heating unit 61 made up of the above-described heater assembly 62, and the heating belt 63 loosely fitted around the heater assembly 62, is disposed on top of, and parallel to, the pressure roller 42 so that the portion of the heater assembly 62, which is coated with the lubricous layer 67, faces downward and opposes the pressure roller 42. As the heating unit 61 is disposed as described above, the left extension 64*b* of the heater assembly 62 extends outward of the housing 44, through the hole with which the left wall 44*e* of the housing 44 is provided. The right end portion of the heater assembly 62, in which the microwave generating device 43 is located, and the right extension 64*b* of the bottom shield 64, extend outward of the housing 44, through the hole with which the right wall 44*f* of the housing 44 is provided. To each of the left and right extensions 64*a* and 64*b*, a preset amount of downward force F is applied by an unshown pressure applying means. With the application of this downward force F, the downwardly facing surface of the heater assembly 62, more specifically, the downwardly facing surface of the lubricous layer 67, presses on the elastic layer 42*b* of the pressure roller 42, deforming (compressing) the elastic layer 42*b*, with the heating belt 63 pinched between the downwardly facing surface of the lubricous layer 67 and upwardly facing surface of the pressure roller 42. As a result, a fixation nip N having a preset width in terms of the recording medium conveyance direction a, is formed between the heating unit 61 and pressure roller 42.

As the pressure roller 42 is rotationally driven, the frictional force generated between the pressure roller 42 and heating belt 63 in the fixation nip N acts on the heat belt 63 in the direction to rotate the heat belt 63. As a result, the heating belt 63 is made to slidingly rotate by this frictional force, around the heater assembly 62 in the clockwise direction, or the direction indicated by an arrow mark in the drawing, while remaining airtightly in contact with the downwardly facing surface (surface of lubricous layer 67) of the heater assembly 62, in the fixation nip N, at roughly the same peripheral velocity as that of the pressure roller 42.

As the microwave generating device 43 of the heater assembly 62 is turned on, the microwaves w are generated and sent into the microwave confinement space 62*a* between the heat generating member 65 and the top shield 66, through the cylindrical hole as the entrance of the hollow container which the bottom and top shields 64 and 66 form. It is by absorbing these microwaves w that the heat generating member 65 located on the inward side of the bottom shield 64 generates heat. As heat is generated by the heat generating member 65, primarily, the bottom shield 64 is quickly heated by the generated heat, roughly uniformly increasing in temperature in terms of the lengthwise as well as circumferential directions.

The temperature of this bottom shield 64 is detected by the unshown temperature sensor TH. Then, the electrical information regarding the temperature detected by this temperature sensor TH is inputted into the CPU 100*a* through an A/D converter 100*f* as shown in FIG. 7, as is the electrical information regarding the surface temperature of the heat roller 42 of the fixing apparatus in the first embodiment. That is, the analog signals outputted from the temperature sensor TH in response to the changes in the temperature of the bottom shield 64 are converted into digital signals, and then, are inputted into the CPU 100*a*, by the A/D converter 100*f*. Based on these temperature data, the CPU 100*a* turns on or off the microwave generating device 43 by controlling the microwave control portion 100*d*, to adjust the temperature of the bottom shield 64.

As the pressure roller 42 is rotationally driven, the heating belt 63 is rotated by the rotation of the pressure roller 42. While the temperature of the bottom shield 64 is controlled so that it remains at the preset fixation level, the recording medium P is introduced into the fixing apparatus 40. That is, the recording medium P which is bearing an unfixed toner image on its surface is introduced into the fixing apparatus 40 through the recording medium entrance 41*g*, from the second transfer portion 14 side. Then, the recording medium P is advanced into the fixation nip N, or the compression nip between the heating unit 61 and pressure roller 42, and is conveyed through the fixation nip N while remaining pinched between the rotating heating belt 63 and pressure roller 42. While the recording medium P is conveyed through the fixation nip N while remaining pinched by the heating unit 61 and pressure roller 42, the recording medium P is heated by the heat from the bottom shield 64 of the heater assembly 62, which is transmitted to the recording medium P through the heating belt 63, while being compressed in the fixation nip N. As a result, the unfixed toner image on the recording medium P is fixed to the surface of the recording medium P by the heat from the bottom shield 64 and the pressure in the fixation nip N. As the recording medium P is conveyed out of the fixation nip N, it is separated from the peripheral surface of the pressure roller 41, and then, is sent out of the fixing apparatus 40 through the recording medium exit 44*h*.

In this embodiment, the heater assembly 62 of the heating unit 61 does not rotate with the movement of the recording medium P. Therefore, it is easier to prevent microwaves from leaking from the microwave generating device 43 and heater assembly 62, and also, it is possible to integrate the heating unit 61 with the microwave shields.

The heating member 65 is placed in the hollow container formed by joining the microwave blocking bottom and top members 64 and 66 (shields). Heat is generated by irradiating the heating member 65 with the microwaves sent into the hollow container. With the employment of this structural arrangement, the microwaves w sent into the hollow container are prevented from leaking out of the container, by the microwave shields 64 and 66 which form the hollow container, or the amount by which the microwaves w leak out of the hollow container can be kept no greater than a preset value (100 mW/cm2). Further, this structural arrangement is greater in the amount by which the microwaves w are absorbed by the heating member 65.

The structures of the bottom and top shields 64 and 66, which are for keeping the two shields reliably joined, and the method for joining the two shields are optional, as long as the amount by which the microwaves w leak from the hollow container which the two shields form can be kept below a permissible level.

It is desired that in order to prevent microwaves from leaking from the portion of the heating unit 61, in which the microwave generating device 43 is located, this portion is also covered with a microwave shield formed of copper, aluminum, or the like, as necessary.

Even if the microwaves cannot be completely blocked by the provision of the microwave shields, the amount by which the microwaves leak out of the heating assembly 62 is extremely small. Therefore, all that is necessary is to surround the heating unit 61 with microwave absorbing members (unshown) so that the amount by which microwaves leak out of the image forming apparatus will be no more than 100 $mW/cm^2$.

The bottom shield 64 is required to efficiently transmit the heat generated by the heating member 65, to the recording medium P and the toner image thereon when they are conveyed through the fixing nip N while remaining pinched between the heating belt 63 and pressure roller 42. In other words, the bottom shield 64 needs to be excellent in heat conduction. Therefore, it is desired to be formed of a substance high in thermal conductivity, for example, copper or aluminum. Further, the employment of the bottom shield 64 which is high in thermal conductivity makes the fixation nip N more uniform in temperature distribution in terms of both the lengthwise and width directions, improving thereby the fixing apparatus in terms of the level of quality at which it fixes an image.

On the other hand, for the purpose of preventing heat from dissipating into the portions of the fixing apparatus, which are not essential for fixation, the top shield 66, that is, the microwave shield which is on the opposite side of the fixing nip N from the bottom shield 64, is desired to be formed of a substance which is small in thermal capacity and lower in thermal conductivity than the substance of which the bottom shield 64 is formed.

For the fixation efficiency, the heating member 65 is desired to be shaped like a piece of rod, and set so that its position roughly corresponds to that of the fixation nip N. Shaping the heating member 65 like a piece of rod makes it unnecessary to hollow out the heating member 65 on purpose, and also, makes it easier to manufacture the heating member 65, because of its configurational simplicity. Further, giving the heating member 65 a rod like shape requires a lesser amount of material, reducing thereby the manufacturing cost. Incidentally, the heating unit 61 may be provided with a heating member 54 in addition to the heating member 65, which is disposed so that its position roughly corresponds to that of the fixation nip N. The heating member 54 is to be disposed outside the area in which the heating member 65 is located.

The provision of the bottom shield 64 is not mandatory, as long as microwaves can be prevented from leaking, by modifying the heating member 65 in shape, thickness, material, etc. That is, the microwave container into which microwaves are sent may be made up of only the top shield 66 and heating member 65, that is, without the bottom shield 64.

The lubricous layer 67 for minimizing the friction between the inward surface of the heating belt 63 and the downwardly facing surface of the heating unit 61 is desired to be provided as necessary.

The structural arrangement for allowing the microwaves w generated by the microwave generating device 43 to be sent into the microwave absorption space 62*a* of the heater assembly 62 does not need to be limited to that in this embodiment, in which the microwaves generated by the microwave generating device 43 are directly sent into the space 62*a*. For example, the microwaves may be sent into the space 62*a* through a microwave guiding tube.

Figure 12:
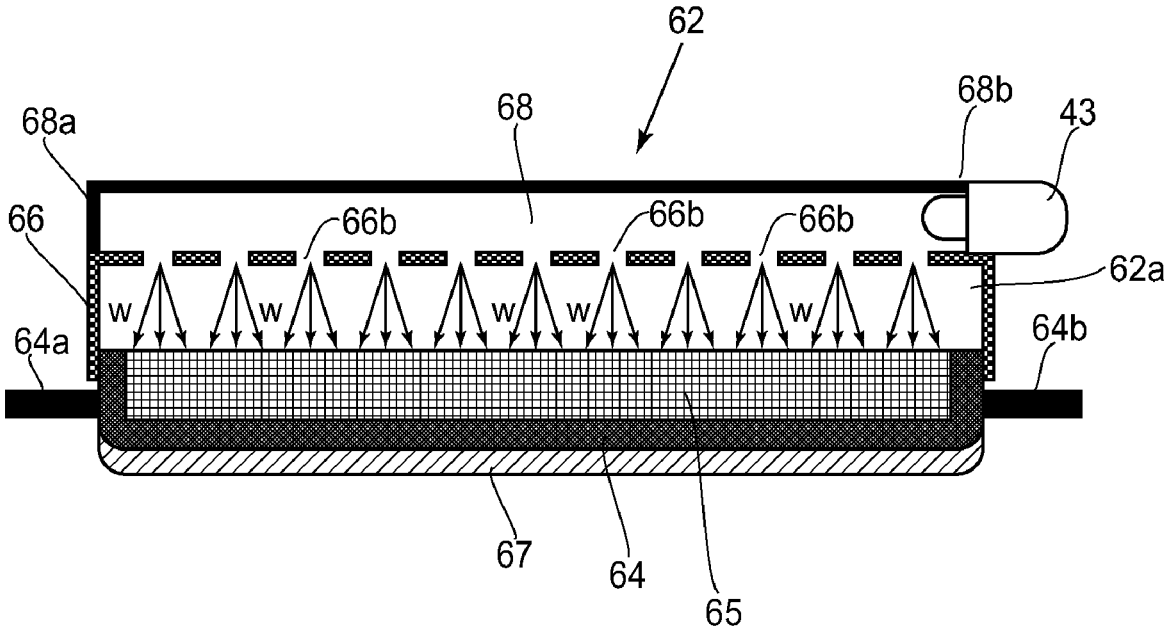
FIG. 12 is a vertical sectional view of a fixing apparatus different in structure from the heater assembly shown in the preceding drawings, showing the general structure thereof.

FIG. 12 shows the structural arrangement, different from the ones described above, for sending the microwaves into the space 62*a* of the heater assembly 62. The heating assembly 62 in this drawing is provided with a microwave guiding tube 68, which is located on top of the top shield 66 and extends in the lengthwise direction of the top shield 66. Like the top shield 64, this microwave guiding tube 68 is also formed of a metallic substance, such as copper, aluminum, stainless steel, or the like, which reflects microwaves, being therefore effective to block microwaves. The lengthwise left end of the microwave guiding tube 68 is sealed, whereas the lengthwise right end of the microwave guiding tube 68 is provided with a cylindrical portion 68*b*, in which the microwave generating device 43 is placed, which is inserted into the cylindrical portion 68*b* through the outward opening of the cylindrical portion. The portion of the top shield 66, which corresponds in position to the microwave guiding tube 68, is provided with multiple holes 66*b* (small holes), which connect the internal space of the microwave guiding tube 68 with the microwave absorption space 62*a*. The microwaves generated by the microwave generating device 43 are guided by the microwave guiding tube 68 across the top surface of the top shield 66, and enter the microwave absorption space 62*a* of the heater assembly 62 through the above-mentioned multiple holes 66*b* of the upwardly facing wall portion of the top shield 66. As a result, the heating member 65 in the microwave absorption space 62*a* generates heat by absorbing the microwaves w.

Incidentally, the heating member 65 may be rendered hollow so that microwaves can be sent into the hollow of the heating member 65. Such a structural arrangement is just as effective as the ones described above.

In this embodiment, the heating belt 63 was used as the recording medium conveying means of the heating unit 61, and also, as the heat transmission medium of the heating unit 61. However, the heating unit 61 may be placed in a heat roller, with no contact between the heating unit 61 and heat roller, to heat the heat roller. Such a structural arrangement is just as effective as that in this embodiment.

While the invention has been described with reference to the structures disclosed herein, it is not confined to the details set forth, and this application is intended to cover such modifications or changes as may come within the purposes of the improvements or the scope of the following claims.

CLAIM OF PRIORITY

This application claims priority from Japanese Patent Application No. 052804/2006, filed Feb. 28, 2006, which is hereby incorporated by reference.

What is claimed is:

1. An image heating roller for heating a toner image on a recording material, said image heating roller comprising:

a heat generation layer for generating heat by using microwaves introduced into a hollow portion of said image heating roller;

a blocking layer, provided on said heat generation layer, for substantially blocking passing of the microwaves; and an introducing portion, provided at one end surface of said image heating roller with respect to a rotation axial direction thereof, for permitting introduction of the microwaves into the hollow portion.

2. An image heating roller for heating a toner image on a recording material, said image heating roller comprising:

a heat generation layer for generating heat by using microwaves introduced into a hollow portion of said image heating roller;

a blocking layer, provided on said heat generation layer, for substantially blocking passing of the microwaves; and a blocking portion, provided at each of opposite end surfaces of said image heating roller with respect to a rotation axial direction thereof, for substantially blocking leakage of the microwaves.

3. An image heating apparatus comprising:

an image heating roller for heating a toner image on a recording material;

a microwave generator for generating microwaves, wherein said image heating roller includes a heat generation layer for generating heat by using the microwaves, generated by said microwave generator, introduced into a hollow portion of said image heating roller, and a blocking layer, provided on said heat generation layer, for substantially blocking passing of the microwaves.

4. An image heating apparatus according to claim 3, further comprising an introducing portion, provided at one end surface of said image heating roller with respect to a rotation axial direction thereof, for permitting introduction of the microwaves into the hollow portion.

5. An image heating apparatus according to claim 3, further comprising a blocking portion, provided at each of opposite end surfaces of said image heating roller with respect to a rotation axial direction thereof, for substantially blocking leakage of the microwaves.

* * * * *